United States Patent [19]

Rodriguez

[11] 4,221,333

[45] Sep. 9, 1980

[54] CONTROLLED THRUST OSCILLATING SPRINKLER

[76] Inventor: Ricardo A. Rodriguez, 39 Suffolk Ave., Hialeah, Fla. 33010

[21] Appl. No.: 949,059

[22] Filed: Oct. 6, 1978

[51] Int. Cl.[2] ..... B05B 3/14

[52] U.S. Cl. ..... 239/255; 239/252

[58] Field of Search ..... 239/98, 255, 252

[56] References Cited

U.S. PATENT DOCUMENTS

| | | | |
|---|---|---|---|
| 846,426 | 3/1907 | Rhodes et al. | 239/98 |
| 1,650,473 | 11/1927 | Steininger | 239/98 |
| 2,564,639 | 8/1951 | Cuppett et al. | 239/98 |
| 2,670,993 | 3/1954 | Nordenstam | 239/255 X |
| 3,078,045 | 2/1963 | Meuche | 239/255 X |

FOREIGN PATENT DOCUMENTS

| | | | |
|---|---|---|---|
| 173388 | 1/1922 | United Kingdom | 239/252 |

*Primary Examiner*—Robert W. Saifer

*Attorney, Agent, or Firm*—Jack E. Dominik

[57] ABSTRACT

A sprinkler, the intrinsic motions of which are powered by the flow of fluid therethrough emanating from an external source of fluid under pressure. Means contained within the sprinkler cause the expulsion of fluid under pressure, first from one tangentially mounted nozzle, and next through an opposed but commonly aligned tangentially mounted nozzle. The torque generated by the alternating expulsion effects the rotation of the sprinkler first in one angular direction, and then in an opposite angular direction. Buffing means is provided to limit the speed of angular rotation.

8 Claims, 17 Drawing Figures

CONTROLLED THRUST OSCILLATING SPRINKLER

BACKGROUND OF THE INVENTION

1. Field of the Invention

The subject matter relates to irrigation devices which irrigate wedge or pie-shaped portions of topography, and more particularly relates to such irrigation devices which are powered by the flow of fluid through them, and which harness the torque generated by opposed nozzles aligned in a common direction.

2. Description of the Prior Art

Sprinklers are known which continually rotate in one direction, thereby irrigating circular patterns. The intrinsic motion of these devices derives from the flow of fluid under pressure from an external source through them. Sprinklers are known which rotate about a horizontal axis, first in one direction and then in the opposite direction. Flow of fluid under pressure through these devices causes a mechanical crank to be operated, which effects the reciprocating motion. Other known devices employ springs for urging the pivoting of a nozzle contra to the direction as urged by the torque of the device, and further employing an arm disposed in the fluid stream.

These prior art devices suffer from the deficiencies inherent in the use of springs and other complicated mechanical means. Rusting or corrosion is a common problem which severely limits the useful lifetime of the devices. Many prior art devices require high pressures for their operation, due to the weight and number of moving parts within them which must be driven by the flow of fluid. Many prior art devices have no mechanism for limiting the speed of rotation. No prior art device appears which has all of the advantages and features of the present sprinkler.

SUMMARY OF THE INVENTION

The aforesaid deficiencies of the prior art devices are overcome by the sprinkler described herein.

It is an object of the present invention to provide a sprinkler which is easy to manufacture, easy to assemble, and which has a minimum number of moving parts.

It is a further object to provide a sprinkler having low internal resistance, to allow its operation at low fluid pressures.

It is an important object of this invention to provide buffing means for inhibiting the speed of operation of the sprinkler, thereby allowing more efficient irrigation of topography.

It is a further object of this invention to provide a sprinkler which can irrigate varying wedge-shaped portions of land.

Another very important object is to provide a sprinkler which operates without the use of springs.

It is thereby yet another object of the invention to provide a sprinkler all of the motions of which derive solely from the pressure supplied by the fluid flow therethrough.

It is another important object of the present invention to provide valve means which open and close abruptly, thereby avoiding stabilization of the sprinkler.

The sprinkler exemplary of the present invention alternately pivots about a vertical axis. A pair of opposed tangentially mounted nozzles provide the alternating thrust which angularly pivots the sprinkler on an alternating basis. The nozzles are disposed at an angle relative to the horizontal plane. An increase of up to about 45° in the said angle will increase the range of the fluid expelled from the sprinkler, whereas a decrease in the said angle will decrease the travel distance of the expelled fluid. In the preferred embodiment, the illustrative sprinkler is provided with a free floating ball plus which is contained within an interior chamber having one dual-position inlet and two fixed position outlets. Each of said outlets is in fluid communication with an associated exterior nozzle. Introduction of fluid under pressure into the said interior chamber will result in the free floating ball plug attempting to escape therefrom via either one of the two said outlets. Its greater dimension will thwart its attempt. Means are provided to cause the inlet to alternate its position with respect to the said interior chamber, such that each alteration in the position of the inlet will result in the free floating ball plug altering its position within the interior chamber, by floating from sealing relationship with one of the outlets, into sealing relationship with the other of the outlets. In a second embodiment, the interior chamber of the invention has a fixed position inlet and a pair of opposing fixed position outlets. Valve means open one of the outlets when the other of the outlets is closed. The mechanism by which the valve means is operated comprises a counterweight member in communcation with the valve member. The valve member and the counterweight member follow an orbital path within this embodiment, until the path of the counterweight member is obstructed by one of a pair of sweep control members. The counterweight member then pivots about its axis and a mechanism is provided which effects a corresponding rotation in the valve member when the pivoting of the counterweight member is substantially complete. In this manner, the valves which control the expulsion of water from the invention are abruptly opened and closed, thereby preventing the invention from stabilizing in a non-rotating disposition.

BRIEF EXPLANATION OF THE DRAWINGS

These and other objects of the invention will be readily apparent as this description proceeds, and by reference to the drawings, in which.

DESCRIPTION OF THE PREFERRED EMBODIMENT

Figure 1:
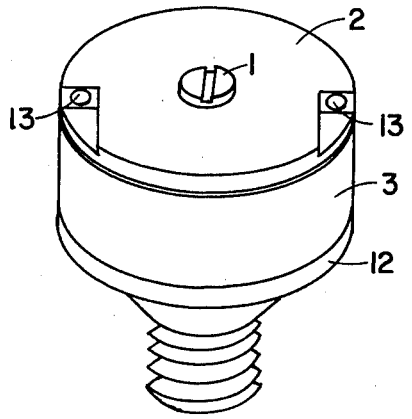
FIG. 1 is a perspective view of the preferred embodiment of the sprinkler.
Figure 2:
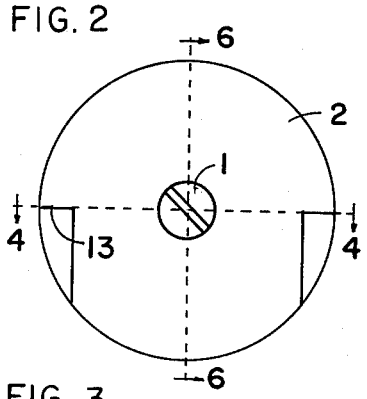
FIG. 2 is a top view of the preferred embodiment as shown in FIG. 1.
Figure 3:
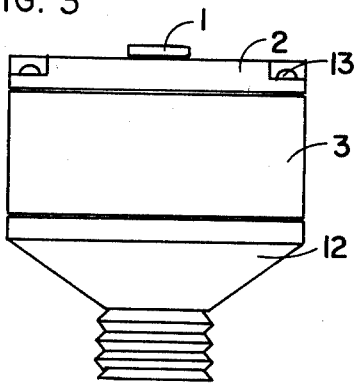
FIG. 3 is a side view of the preferred embodiment as shown in FIG. 1.
Figure 4:
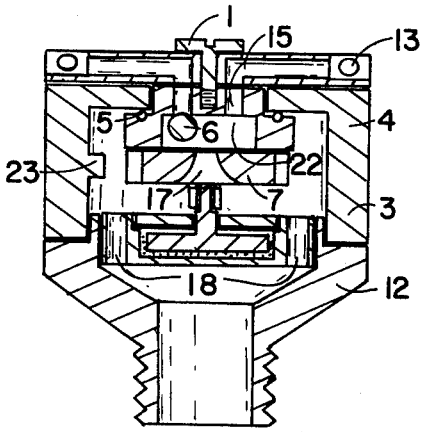
FIG. 4 is a cross-sectional view of the preferred embodiment taken along cross-section line 4—4 of FIG. 2.
Figure 5:
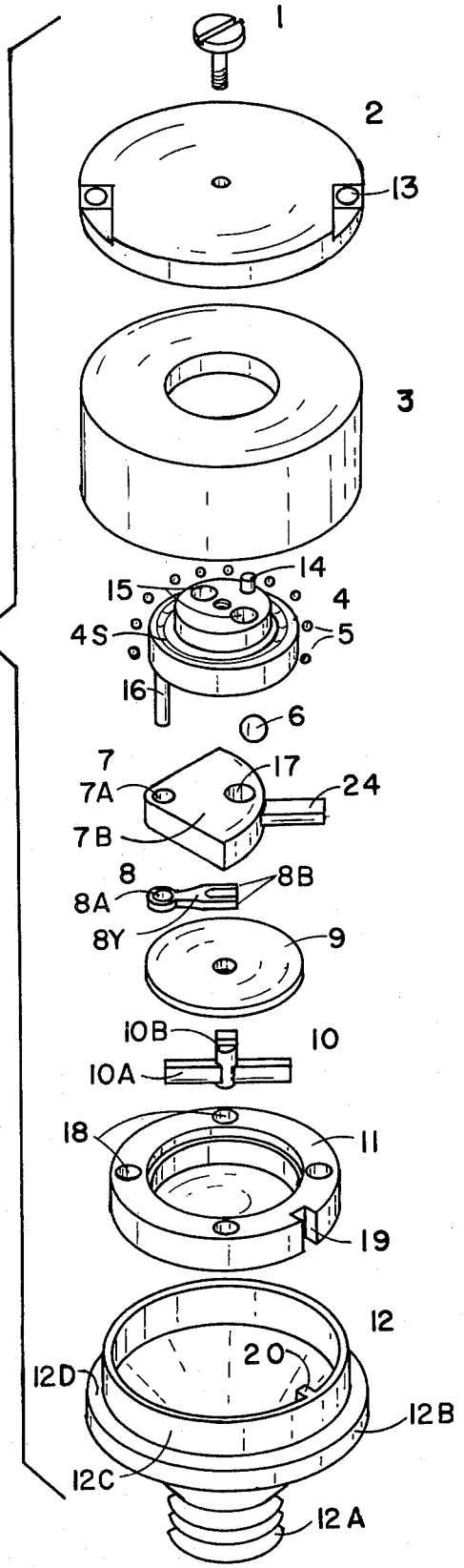
FIG. 5 is an exploded perspective view of the preferred embodiment showing the relationship between all its components.

FIGS. 1-9 show the preferred embodiment. FIG. 5 shows, in exploded form, a integrally formed hollow connector member 12, having lower, middle and upper portions 12A, 12B, and 12C. The lower portion 12A is provided with external threading to achieve screw threaded relationship with an external source of fluid under pressure and is further provided with an internal bore for receiving said fluid therethrough. Said lower portion is formed integrally at its uppermost end with the middle portion 12B, which is a horizontally disposed annular flange having a diameter greater than the diameter of the screw threaded lower portion. Concentrically aligned with the flange portion, but having a lesser diameter and projecting upwardly from the inner periphery thereof, is the upper portion 12C of the connector member, the aforesaid disposition of which defines an annular shoulder portion 12D. An inwardly projecting key member 20 is formed on the inner surface of the connector upper portion 12C, said key being configured and dimensioned to receive key way 19 of the buffing matter containing member 11.

The diameter of the buffing matter container 11 is substantially equal to the inner diameter of the upper portion of the connector member 12C and is formed to fit securely therein. The buffing matter container 11 is provided about its perimeter with a plurality of flow holes 18 to permit externally supplied fluid under pressure entering the connector member to escape therefrom through said flow holes 18.

In this illustrative embodiment of the invention, the connector member 12 is brought into screw-threaded engagement with an external source of fluid under pressure, and the buffing matter container 11 is then pressure fitted into relationship with the connector member 12 by cooperatively aligning the key 20 and key way 19. Buffing matter 21 is then introduced into the cavity of the buffing matter container 11.

The buffing matter agitator 10 is then placed in contact with the buffing matter 21. The buffing matter agitator 10 comprises a horizontal portion 10A and a vertical or neck portion 10B projecting upwardly from the midpoint thereof. The neck portion protrudes through an opening centrally disposed in the container cap 9 and is held by means of a pressure fit at its uppermost free end by the connecting arm 8. Thus, the container cap serves the function of sealing the buffing matter 21 best illustrated in FIG. 6 and the horizontal portion of the buffing matter agitator 10 within the cavity of the buffing matter container 11. Thus, when the subject sprinkler rotates in the manner herafter described, the speed of the rotation is inhibited by the friction existing between the horizontal portion of the buffing matter agitator 10 and the buffing matter 21. The connecting arm 8 serves the dual purpose of clamping the neck 10B of the buffing matter contacter 10, and transmitting the rotary motion of the invention to the buffing matter contacter 10, as hereafter described.

The mechanism by which the reciprocal motion of the invention is transmitted by the connecting arm 8 to the buffing matter contacter 10 will now be described. The connecting arm 8 comprises an integrally formed elongated member provided with an opening 8A extending therethrough at one end thereof, and a yoke portion 8Y at the opposing end. The yoke portion comprises a pair of coplanar, transversely spaced apart arm members 8B, defining a bight portion therebetween which clamps the outermost free end of the buffing matter contacter 10 by means of a pressure fit as aforesaid. The apertured portion 8A is adapted to receive head base leg 16 which depends upon the perimeter of rotary head base 4. Intermediate of said connecting arm 8 and said rotary head base 4 is a stream flow positioner 7. The depending head base leg 16 extends through an opening 7A provided in the stream flow positioner 7, and through the opening 8A provided in the connecting arm 8. Thus, rotation of the rotary head base 4 is transmitted via the head base leg 16 to the stream flow positioner 7 and the connecting arm 8, which in turn transmits said rotation to the buffing matter agitator 10.

In the preferred embodiment, the stream flow positioner 7 has a body portion 7B and a control arm 24 projecting therefrom on a horizontal plane. Extending through the body portion of the stream flow positioner 7 is a stream positioner orifice 17, which is aligned with the control arm 24, so that pivoting of the control arm 24 about the pivotal axis defined by the said depending head base leg 16 will effect a simultaneous and corresponding pivoting of the stream positioner orifice 17.

When the sprinkler is assembled, the vertical dimension of the connecting arm 8 will define the spatial disposition between the container cap 9 and the stream flow positioner 7. Thus, fluid under pressure attempting to escape from the sprinkler will be constrained to enter the space defined by the container cap 9 and the stream flow positioner 7, all other avenues of escape being sealed at all times. Thus, it is through the stream positioner orifice 17 that fluid must enter as it attempts to escape the invention by following the course of least resistance as best illustrated in FIG. 4.

The fluid under pressure flowing upwardly through the stream positioner orifice 17 is discharged into a ball plug compartment 22, which compartment comprises a cavity formed within the rotary head base 4.

The upper portion of the ball plug compartment 22 is in fluid communication with a pair of nozzle conduits 15, disposed at opposing ends of the ball plug compartment 22. The nozzle conduits 15 terminate in a pair of exterior nozzles 13, each nozzle being associated with one of the nozzle conduits 15. Thus, fluid under pressure escapes from the ball plug compartment 22 via either of the nozzle conduits 15 on an alternating basis as hereafter described, and is thereafter discharged, through one of a pair of exterior nozzles 13, best illustrated in FIG. 4. The nozzles are shown as diametrically opposed, tangentially mounted, commonly aligned and formed integrally with the rotary head 2. It will be appreciated that the nozzles need not be diametrically opposed, nor need they be tangentially mounted, nor need they be in precise alignment, for the sprinkler to be operative. In the preferred embodiment, the axis of explusion of the nozzles lies in a plane between 30° to 45° relative to the horizontal. Thus, fluid escaping the sprinkler is projected outward and upward at an angle, thereby irrigating portions of topography at greater distances than could be achieved if said nozzles were disposed on a horizontal plane. FIG. 3 indicates the upward slope of the horizontal portion of the nozzle. Oscillation of the rotary head 2 which is effected by the thrust generated by the fluid escaping through one of the nozzles 13, is transmitted to the rotary head base via a dowel member 14 which is formed integrally with the rotary head base 4, and which projects upwardly therefrom and is received within a recess formed on the underside of the rotary head 2. The rotary head 2 and the rotary head base 4 are further fixedly secured each to the other via a screw 1 which is in screw threaded relationship with the rotary head base 4.

In the assembly of the sprinkler, the buffing matter container 11, the buffing matter 21, the buffing matter agitator 10, the container cap 9, the connecting arm 8, the stream flow positioner 7, and the rotary head base 4, are encased by the central frame 3. Said central frame 3 is held and supported by the shoulder portion 12D of the connector member 12. The annular point of contact between the shoulder portion 12D of the connector member 12 and the lower portion of the central frame 3 are sealed, thereby defining a cavity which encases the above-recited members. In this manner, the fluid under pressure is constrained to escape from the sprinkler along the opposed alternative paths, defined by the stream positioner orifice 17, the ball plug compartment 22, one of the outlets, its associates nozzles conduit, and the associated external nozzle. It will now be seen that the connector member 12, the buffing matter container 11, the container cap 9 and the central frame 3 cannot rotate because they are fixedly secured to each other and to the external source of fluid. Thus, bearings 5 are disposed upon the shoulder portion 4S of the rotary head base 4 to allow relatively friction-free rotation of the rotary head base 4 relative to the central frame 3. The upward pressure of the fluid within the sprinkler serves to lift the rotary head 2 from the central frame 3, allowing floating relative oscillation therebetween.

Figure 6:
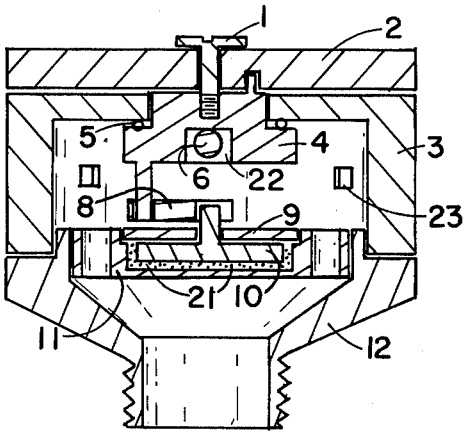
FIG. 6 is a cross-sectional view of the preferred embodiment taken along cross-section line 6—6 of FIG. 2. Parts not pertinent to the torque buffing system have been omitted to achieve clarity.

A pair of sweep angle controls 23 best illustrated in FIG. 6, are formed integrally on the inner surface of the central frame 3. These make contact with the control arm 24 of the stream positioner 7, when the sprinkler oscillates. Thus, when the sprinkler is angularly rotating in one direction, control arm 24, which projects from the stream flow positioner 7, will strike a sweep angle control 23, which being fixedly positioned will effect the pivoting of the control arm 24 about the axis of the head base leg 16. Thus, the stream positioner orifice 17 will rotate angularly in a direction opposite from the original path of travel. This second path of travel will thereafter be interrupted by the other sweep angle control 23 disposed interiorly of the central frame 3, and the process will repeat itself.

Figure 7:
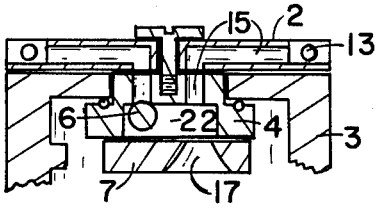
FIG. 7 is a partial cross-sectional view of the preferred embodiment as shown in FIG. 4 illustrating one nozzle conduit closed and the stream positioner orifice located below the open nozzle conduit.

Captive within the ball plug compartment 22, is a ball plug 6, which is free to float within said ball plug compartment 22. Referring to FIG. 7, it will be seen that when the stream positioner orifice 17 is in fluid communication with one end of the ball plug compartment 22, the force of the fluid flow will cause the ball plug 6 to float to the opposing end of the ball plug compartment 22. The ball plug 6 will attempt to escape the ball plug compartment 22 and will thereby become lodged at the point of fluid communication between the opposing nozzle conduit 15, and the ball plug compartment 22, thus preventing the flow of fluid through said nozzle conduit 15 and its associated exterior nozzle 13. Fluid will therefore be expelled from one of said exterior nozzles 13 to the exclusion of fluid flow through the opposing exterior nozzle 13. The thrust of this expulsion will generate sufficient torque to cause the invention to rotate about its vertical axis.

Figure 8:
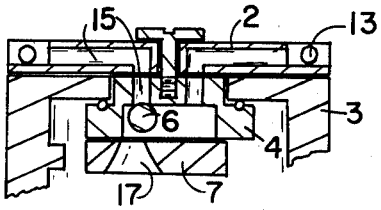
FIG. 8 is a partial cross-sectional view of the preferred embodiment as shown in FIG. 7, but with the stream positioner orifice relocated under the plugged conduit.
Figure 9:
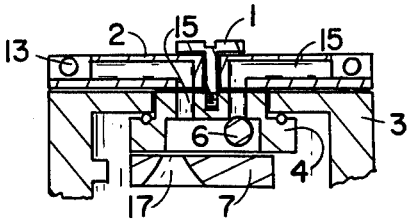
FIG. 9 is a partial cross-sectional view of the preferred embodiment as shown in FIG. 8 showing the plug shifted to the previously opened conduit.

When the control arm 24 is pivoted about its axis by making contact with one of the stationary sweep angle controls 23, the position of the stream positioner orifice 17 will be changed to the opposing end of the ball plug compartment 22. FIG. 8 depicts the position of the ball plug 6 at the moment when the stream positioner orifice 17 has rotated angularly in a direction opposite from its first direction of travel. It will be seen at this moment that fluid under pressure will continue to flow out of the ball plug compartment 22 through the nozzle conduit 15 which is still unplugged. However, the low pressure area resulting from the escape of the fluid under pressure through the nozzle conduit 15 and its associated external nozzle 13, together with the turbulence resulting from the fluid flowing through the stream positioner orifice 17, will cause the ball plug 6 to dislodge from its position. The ball plug then floats toward the point of fluid communication between the opposing nozzle conduit and the opposing end of the ball plug compartment 22. The position now taken by the ball plug 6 is best seen in FIG. 9. Comparing FIGS. 7 and 9, it will be seen that the stream positioner orifice 17 has moved from one end of the ball plug compartment 22 to the other end of the ball plug compartment. This change in positioning of the stream positioner orifice 17 results in a change of positioning of the ball plug 6.

Thus, the proposition that fluid will follow the course of least resistance, thereby creating a low pressure area along its path, has been employed to effect the oscillating movement of the ball plug 6. The diameter of the ball plug 6 must exceed the diameter of any outlet such as nozzle conduits 15.

DESCRIPTION OF AN ALTERNATIVE EMBODIMENT

Figure 10:
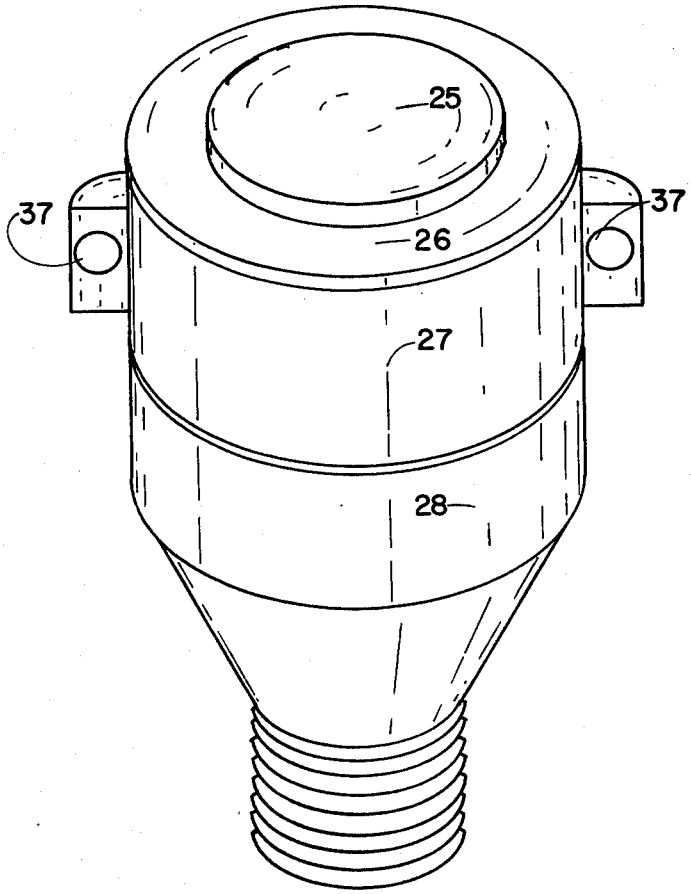
FIG. 10 is a perspective view of an alternative embodiment of the invention.
Figure 11:
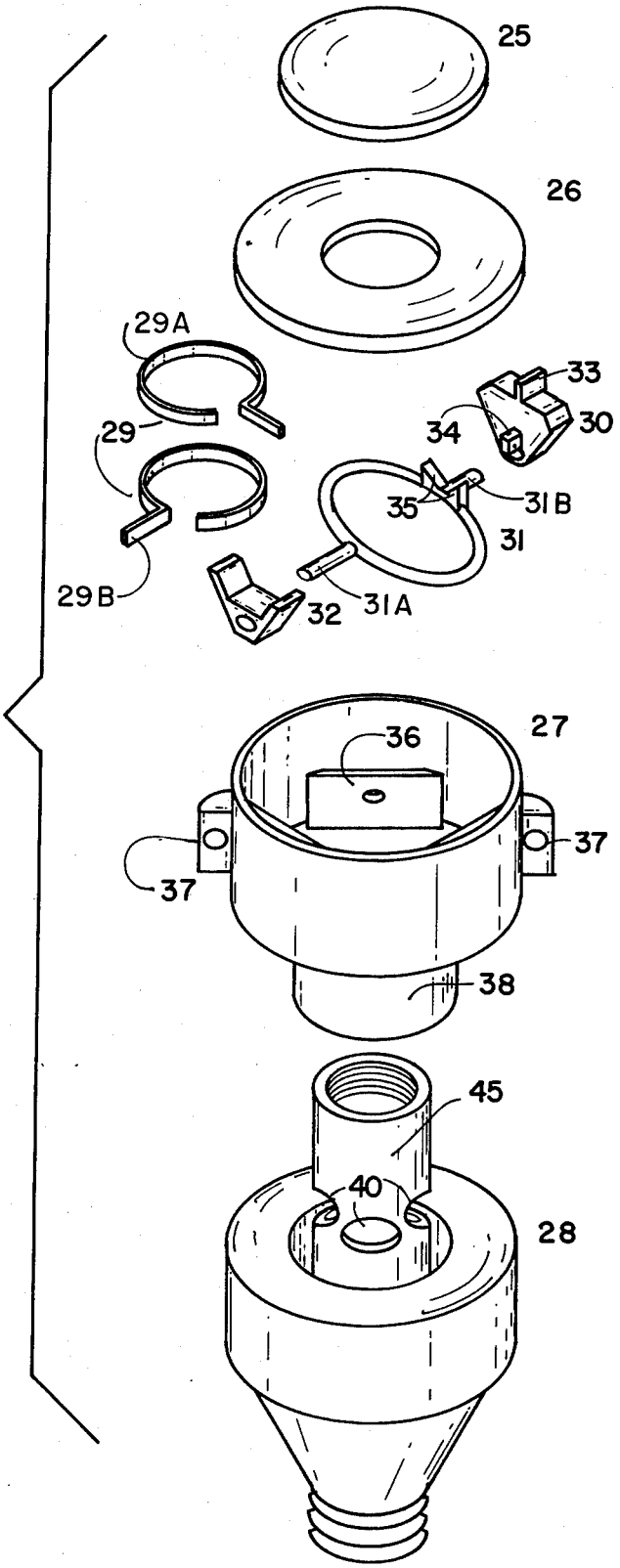
FIG. 11 is an exploded perspective view of the alternative embodiment.
Figure 14:
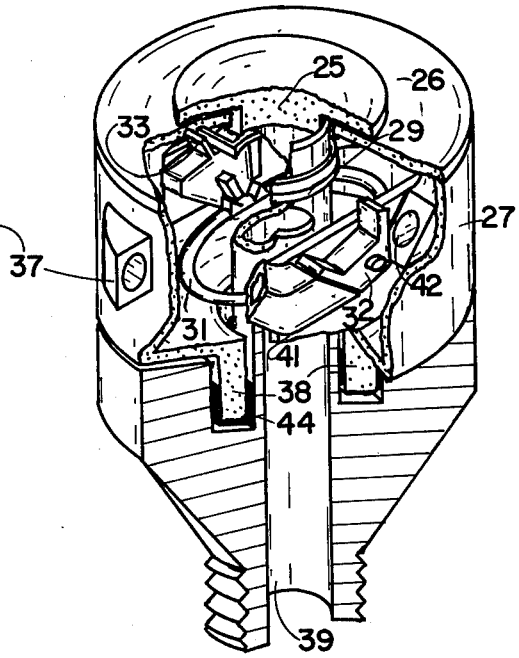
FIG. 14 is a fragmentary perspective view of the alternative embodiment.

FIGS. 10–17 show an alternative embodiment. FIG. 10 shows a connector member 28. Its lower portion is provided with external threads, as an appropriate means for connecting it to an external source of fluid under pressure. The connector member is an integrally formed unit. A central bore 39, best seen in FIG. 14, is provided, which allows fluid under pressure to enter the connector member. A central conduit 45, best seen in FIG. 11, is shown, the same having apertures 40 formed therein, spaced radially about the perimeter thereof. To cause the water under pressure to exit the apertures 40, a sealing cap 25, best seen in FIG. 11, is provided, which said cap is secured by suitable means at the uppermost free end of the said central conduit 45. By reference to FIG. 11, it will be seen that in the construction of this illustrative embodiment, the said sealing cap 25 is not secured to the uppermost free end of the central conduit 45, until the balance of the components of the sprinkler are first assembled.

Figure 13:
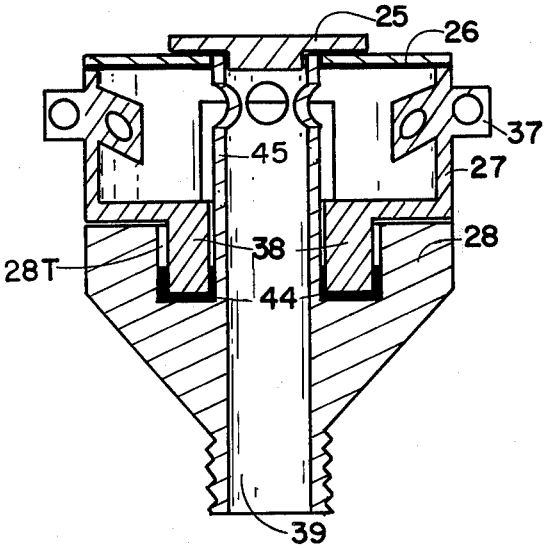
FIG. 13 is a side elevational view of the alternative embodiment cut cross-sectionally along its major structural components along the representative cross-section line 13—13 of FIG. 12.
Figure 15:
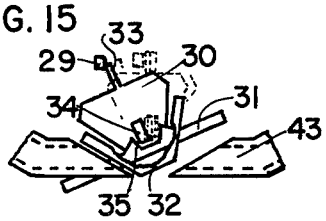
FIG. 15 is a partial side view of the valve mechanisms and the internal nozzle conduits, showing their relative positions and the relative motions of the sweep control clips, and counterweight as they occur near the end of sweep.
Figure 16:
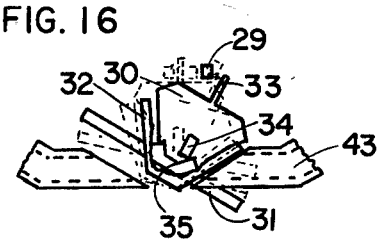
FIG. 16 is a partial side view of the valve mechanisms as depicted in FIG. 15 showing the nozzle valve, the counterweight, the sweep control clip and the support shaft as they would appear when the motions depicted in FIG. 15 are terminated.
Figure 17:
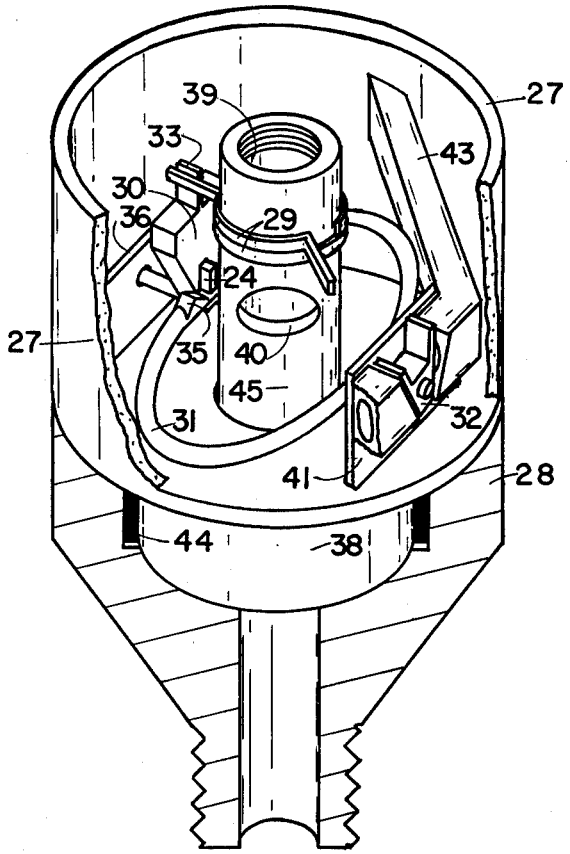
FIG. 17 is a perspective view of hollow rotary unit in position over the central hollow frame with sections cut out to better illustrate its internal construction.

Referring to FIG. 13, it will be seen that a toroidal-shaped cavity 28T is formed by the inner surfaces of the connector member 28, and the outer surfaces of the lower portion of the central conduit 45. On the floor of this toroidal-shaped cavity is disposed buffing matter 44, best seen in FIG. 13. The purpose of the buffing matter will be explained as this description proceeds.

In the construction of this embodiment, a rotary unit 27, best seen in FIG. 11, is coaxially aligned with the connector member 28, and placed thereon. Formed integrally with the rotary unit 27 and depending therefrom, is a buffing matter contact extension member 38, best seen in FIG. 11. Thus, when the rotary unit 27 is coaxially aligned with, and placed upon the connector member 28, the said buffing matter contact extension member 38 rests on and is supported by the buffing matter 44.

The said rotary unit 27 is further provided with diametrically opposed tangentially mounted, commonly aligned external nozzles 37. It will be understood that the sprinkler will oscillate with non-diametrically opposed and non-tangentially mounted and non-precisely aligned nozzles. It is critical, however, that the nozzles be substantially in common alignment. Fluid is expelled on a horizontal plane or on an angle relative thereto, preferably between 30°–45°, through the external nozzles 37 on an alternating basis, in the manner hereafter described. Each of the said external nozzles 37 is in fluid communication with an associated internal nozzle 42 by means of a nozzle conduit 43 best seen in FIG. 12. In this illustrative embodiment, the interior nozzles are formed on an associated beveled surface.

To cause the fluid entering the chamber of the rotary unit 27 to be expelled from the exterior nozzles 37, a rotary unit cover 26, best seen in FIG. 11, is provided. Whereas the function of the sealing cap 25 is to cause fluid flowing through the central conduit 45 to pass through the radially-spaced apertures 40, it is now seen that the function of the rotary unit cover 25 is to cause the fluid in the chamber of the rotary unit 27 to be expelled therefrom, via the internal nozzles 42, the nozzle conduits 43, and the external nozzles 37. It will be seen by reference to FIG. 11, that in the construction of the invention, the said rotary unit cover 25 is not secured to the rotary unit 27 until the final stages of assembly of the invention.

The means for causing the fluid to be expelled from the external nozzles 37 on an alternating basis will now be described. The assembly which accomplishes such purpose is best seen in FIG. 11. A support ring 31 is disclosed, said support ring having diametrically opposed forward shaft member **31*a* and rear shaft member 31*b*, projecting therefrom on a horizontal plane. Slidingly engaged upon the said front shaft member 31*a* is nozzle valve member 32. The opposing faces of the nozzle valve member 32 are beveled. The dimensions and configuration of the said opposing beveled surfaces are such that the beveled surfaces of the internal nozzles 42** can be placed in juxtaposition therewith, in the manner hereafter described.

Figure 12:
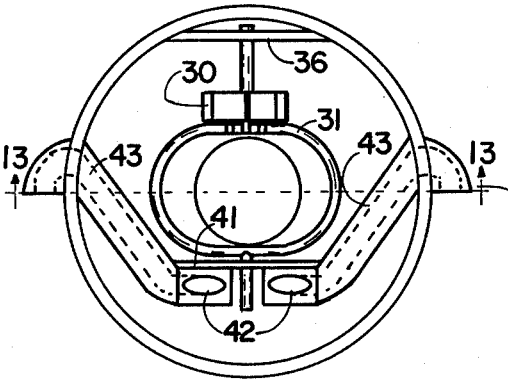
FIG. 12 is a top plan view of the hollow rotary unit showing the internal location of the nozzle conduits, the diametrically opposed nozzles, the internal nozzle orifices, the support shaft, the shaft supports and the counterweight. The valve is omitted to show the orifices clearly.

Pivotably attached to the said rear shaft member **31*b* is a counterweight member 30. Formed integrally with the counterweight member on the uppermost surface thereof, and projecting upwardly therefrom is a counterweight turning arm 33. Projecting from the inner surface of the said counterweight member is a counterweight contact member 34, best seen in FIG. 11. When the counterweight member 30 is pivotably attached to the rear shaft member 31*b* the counterweight contact member 34 will be intermediate of the opposing surfaces of V-shaped turning shoes 35, best seen in FIG. 11. The said turning shoes 35 are formed integrally with the support ring 31 and project upwardly therefrom, being formed on the upper surface of said support ring 31 at the point of juncture of the ring and the rear support shaft member 31*b*. When the valve member 32 is slidingly engaged on the front shaft member 31*a* and the counterweight member 30 is pivotably attached to the rear shaft member 31*b*, the said valve member, and ring member form a single, rigid unit. This rigid unit is now pivotably secured to the inner walls of the rotary unit 27. The rear shaft member 31*b* is pivotably supported by rear support 36, best seen in FIG. 11. The front shaft member 31*a* is pivotably supported by a front support 41 best seen in FIG. 12. The assembly is therefore free to pivot about the horizontal axis defined by said front and rear shaft members. Thus, when the rotary unit 27 is caused to rotate about its vertical axis in the manner hereafter described, such rotation will effect a simultaneous and corresponding rotation of the valve member, ring member, and counterweight member assembly. As best seen in FIG. 12, when the said assembly is secured within the chamber of the rotary unit 27, the opposing beveled surfaces of the valve member 32 and the associated opposing beveled surfaces of the interior nozzles 42 will be in complementary relationship. When counterweight member 30 is pivoted about the axis represented by the front and rear shaft members 31*a* and 31*b* in the manner hereafter described, the counterweight contact member 34 will pivot, but will not contact an associated face of the turning shoe 35 until the pivoting is substantially complete, i.e., until the counterweight member 30 has pivoted through its center of gravity. In this manner, "play" is introduced into the valve mechanism. Thus, the pivoting of the counterweight member 30 about its axis, being rear shaft member 31*b*, does not effect a corresponding pivoting of valve member 32 until the counterweight member has passed its center of gravity. In this manner, the counterweight contact memer 34 abruptly contacts an associated face of the turning shoes 35, thereby effecting an abrupt pivoting of the entire ring assembly about its axis as defined by front and rear shaft support members 31*a* and 31*b*. Thus, the valves are opened and closed abruptly. Failure to provide such a feature will result in the gradual opening of one valve and the gradual closing of the other valve, thereby causing the device to achieve a non-oscillating state of equilibrium when the fluid escaping therefrom is equally proportioned between said commonly aligned exterior nozzles. Thus, it is seen that it is the alternating pivoting of the counterweight member 30, about the axis defined by said front and rear shaft members, 31*a* and 31*b*, that effects the alternating pivoting of the valve member 32, thereby causing water to be expelled from the chamber of the rotary unit 27 on an alternating basis, first through one internal nozzle 42, its associated nozzle conduit 43, and its associated external nozzle 37**, and next through the other external nozzle via its associated conduit and internal nozzle.

The means by which the alternating pivoting of the counterweight member 30 is accomplished will now be described. A pair of sweep control clips 29 are disclosed and best seen in FIG. 11. The said clips, in this embodiment, have an annular portion 29*a* and a projection portion 29*b*. The projection portions 29*b* are provided to engage the counterweight turning arm 33 in the manner hereafter described. The sweep control clips 29 are placed in pressure-wrapped relationship with the central conduit 45, spaced downwardly from the uppermost free end thereof. The clips are positioned so that the projection portions 29*b* define a predetermined angle therebetween. When the invention rotates in the manner hereafter described, the angular sweep of the said rotation is defined by the positioning of the sweep control clips 29. Thus, if the user of the invention desires to irrigate a pie-shaped portion of a lawn, the arc portion of which extends, for example, 30°, the said projection portions 29*b* will be placed 30° apart. If the user of the invention desires to irrigate a portion of a lawn, in a circular pattern the arc portion of which is 210°, for example, the sweep control clips 29 are then positioned so that the projection portions 29*b* define the desired angle. Thus, in this embodiment, the annular portion 29*b* of the rings are securely but adjustably mounted on the central conduit member 45.

Having assembled the ring assembly and having positioned the sweep control clips 29 at the desired angle as aforesaid, the rotary unit cover 26 is securely mounted on the rotary unit 27 and the sealing cap 25 is thereafter securely mounted on the uppermost free end of the central conduit 45. This completes the assembly of the invention. However, the said sealing cap 25 does not contact the rotary unit cover 26, thus freeing the rotary unit cover 26 to rotate with the rotary unit 27 in the manner hereafter described.

Introduction of fluid under pressure through the central bore 39 will cause the said fluid to enter the chamber of the rotary unit 27 and to be expelled therefrom by entering an exposed internal nozzle 42 thereafter entering the nozzle conduit 43 associated therewith and thereafter passing through its associated external nozzle 37. Due to the beveled configuration of the valve member 32, when one internal nozzle 42 is open, the other internal nozzle is closed. Thus, when fluid is expelled through one external nozzle 37 the reactive torque generated by the expulsion will cause the rotary unit 27 to move in a direction opposite to the direction of the fluid travel. In this manner the rotary unit 27 will continue to pivot about its vertical axis until the counterweight turning arm 33 of the counterweight member 30 contacts the projection portion 29*b* of one of the sweep control clips 29. The projection portion 29*b* presents a barrier to the counterweight turning arm 33 thereby preventing the counterweight from continuing to advance along its predetermined path. Thus, the counterweight is pivoted about the axis of the rear shaft member 31*b* thereby causing the delayed pivoting of the valve member 32 about its axis, the front shaft member 31*a*. Thus, one beveled surface of the valve member 32 will rapidly withdraw from an associated beveled surface of an interior nozzle 42 and the opposing beveled surface of the valve member 32 will contact the opposed interior nozzle 42. The fluid under pressure in the chamber of the rotary unit 27 will seek the path of least resistance which leads from the chamber of the rotary unit. Thus, fluid will be expelled from the exterior nozzle 37, symmetrically opposed to the exterior nozzle which had theretofore provided the angular thrust for oscillation. Since the exterior nozzles 37 expel fluid in a common direction, the alternating expulsion of fluid through the nozzles will cause the rotary unit 27 to oscillate in alternating angular directions. It is the function of the buffing matter 44 to inhibit the rotation of the rotary unit 27. This allows the reciprocating rotation described herein to proceed at a deliberate pace. The inhibiting effect results from the resistance of the buffing matter to the rotation of the buffing matter connector external member 38.

It is understood that a plurality of exterior nozzles 37 could be provided on the rotary unit 27. It is also understood that other mechanisms are available which will effect the alternating rotation of the rotary unit 27.

Although particular embodiments of the invention have been shown and described in full here, there is no intention to thereby limit the invention to the details of such embodiments. On the contrary, the intention is to cover all modifications, alternatives, embodiments, usages and equivalents of the subject invention as fall within the spirit and scope of the invention, specification and the appended claims.

What is claimed is:

1. An irrigation device comprising, a non-rotating member having a central liquid-receiving bore for connection to an external source of liquid under pressure, a non-rotating hollow housing fixedly secured to said connecting member, a rotating head having at least two opposed, commonly aligned liquid discharge nozzles rotatably attached to said hollow housing, said hollow housing defining a first liquid-receiving interior chamber, ball housing means disposed in said first interior chamber for defining a second or innermost interior chamber, said ball housing means attached to said rotating head so that rotation of said head effects concomitant rotation of said housing means, said ball housing means having a pair of opposed outlets in fluid communication with said discharge nozzles, said ball housing means having a bistable inlet that provides fluid-communication between said first interior chamber and said second or innermost interior chamber, said ball housing means accomodating a free-floating ball plug adapted to seat and seal said outlets on a reciprocating basis as urged by hydraulic forces appearing in said innermost chamber, said inlet in a first stable state when disposed at one end of said innermost housing and in a second stable state when disposed at an opposed end of said innermost housing, means for causing said bistable inlet to change from one stable state to the other stable state when an irrigation sweep has been completed.

2. The irrigation device of claim 1, said bistable inlet comprising a flow positioning member having an opening therethrough, said flow positioning member pivotally attached to a leg depending from the perimeter of said ball housing means so that rotation of said ball housing means effects concomitant rotation of said inlet-carrying flow positioning member, said depending leg defining the axis about which said flow positioning member pivots when said bistable inlet changes from one stable condition to its other stable condition, said non-rotating hollow housing having adjustably positionable barrier means projecting inwardly into said first interior chamber, said flow positioning member having a projecting portion aligned to engage said inwardly projecting barrier means so that when said flow positioning member is rotating concomitantly with said rotating head, said projecting portion will engage said barrier means, causing said flow positioning member to pivot about said axis, thereby causing said inlet to travel from one end of said ball housing means to the opposed end, said change in position causing said ball plug to dislodge from one of said outlets and to travel to and seat against and seal the other said outlet in response to said repositioning of said flow positioning member.

3. The device of claim 2, said non-rotating hollow housing having a centrally disposed opening formed in its upper wall for receiving therethrough a portion of said rotating ball housing means, said rotating ball housing means having an outlet-carrying portion projecting through said opening that abuts said rotating head and is attached thereto, said rotating ball housing means having a ball plug-containing portion integrally formed with said upwardly projecting portion, said plug-containing portion having a greater diameter than said outlets-carrying portion so that a shoulder portion is defined therebetween, said shoulder portion abutting said non-rotating hollow housing upper wall at the underside thereof, adjacent said centrally disposed opening, friction reducing means disposed at the interface of said shoulder portion and said underside of said upper wall so that the upward thrust of liquid through said irrigation device causes said rotating head having discharge nozzles to rise upwardly relative to said stationary, non-rotating hollow housing, thereby eliminating contact between the two said parts, and so that the friction-reducing means disposed at said interface allows said irrigation device to function even at low liquid pressures.

4. The irrigation device of claim 3 wherein said friction-reducing means comprises an annular ball race.

5. The irrigation device of claim 4, said irrigation device having buffing means for inhibiting the speed of angular rotation of said device.

6. The irrigation device of claim 5, said non-rotating connector member, having a liquid-receiving central bore, adapted to engage a buffing matter container member that has a cavity therein, said cavity containing buffing matter, said cavity further containing an agitator for contacting said buffing matter, means for connecting said agitator to said rotating head so that the friction between the agitator and the buffing matter will inhibit the angular velocity of said rotating head.

7. The irrigation device of claim 6, said buffing matter container member having a plurality of openings formed in its periphery for allowing passage of liquid under pressure therethrough so that said liquid flows into said chamber defined by said non-rotating hollow housing through said peripheral openings.

8. The irrigation device of claim 7, said buffing matter container member having a closure lid with a centrally disposed aperture formed therein, said agitator having a portion protruding through said centrally disposed aperture into said first chamber defined by said non-rotating hollow housing, said protruding portion engaged by a connector arm that is attached to said depending leg of said rotating ball housing so that rotation of said ball housing effects concomitant rotation of said connector member which in turn causes said agitator to rotate relative to said buffing matter.

* * * * *